United States Patent [19]

Pareg

[11] Patent Number: 4,936,374

[45] Date of Patent: Jun. 26, 1990

[54] SIDEWALL CONTAINMENT OF LIQUID METAL WITH HORIZONTAL ALTERNATING MAGNETIC FIELDS

[75] Inventor: Walter F. Pareg, Palos Park, Ill.

[73] Assignee: The United States of America as represented by the United States Department of Energy, Washington, D.C.

[21] Appl. No.: 272,353

[22] Filed: Nov. 17, 1988

[51] Int. Cl.[5] ..... B22D 27/02; B22D 11/06

[52] U.S. Cl. ..... 164/503; 164/467; 164/428; 164/480

[58] Field of Search ..... 164/480, 428, 466, 467, 164/502, 503

[56] References Cited

U.S. PATENT DOCUMENTS

| | | | |
|---|---|---|---|
| 4,607,681 | 8/1986 | Tinnes et al. | 164/453 |
| 4,762,653 | 8/1988 | Senillou et al. | 164/503 |

FOREIGN PATENT DOCUMENTS

| | | | |
|---|---|---|---|
| 2396612 | 3/1979 | France | 164/147.1 |
| 57-177861 | 11/1982 | Japan | 164/466 |
| 60-106651 | 6/1985 | Japan | 164/502 |
| 62-104653 | 5/1987 | Japan | 164/480 |

*Primary Examiner*—Kuang Y. Lin

*Attorney, Agent, or Firm*—Helen S. Cordell; John M. Albrecht; William R. Moser

[57] ABSTRACT

An apparatus for confining molten metal with a horizontal alternating magnetic field. In particular, this invention employs a magnet that can produce a horizontal alternating magnetic field to confine a molten metal at the edges of parallel horizontal rollers as a solid metal sheet is cast by counter-rotation of the rollers.

43 Claims, 15 Drawing Sheets

SIDEWALL CONTAINMENT OF LIQUID METAL WITH HORIZONTAL ALTERNATING MAGNETIC FIELDS

CONTRACTUAL ORIGIN OF THE INVENTION

The U.S. Government has rights in this invention under Contract No. W-31-109-ENG-38 between the U.S. Department of Energy and the University of Chicago, operator of Argonne National Laboratory.

BACKGROUND OF THE INVENTION

This invention relates generally to the casting of metal sheets and is particularly directed to the vertical casting of metal sheets between counter rotating rollers.

Steel making occupies a central economic role and represents a significant fraction of the energy consumption of many industrialized nations. The bulk of steel making operations involves the production of steel plate and sheet. Present steel mill practice typically produces thin steel sheets by pouring liquid steel into a mold, whereupon the liquid steel solidifies upon contact with the cold mold surface. The solidified steel leaves the mold either as an ingot or as a continuous slab after it is cooled typically by water circulating within the mold wall during a solidification process. In either case, the solid steel is relatively thick, e.g., 6 inches or greater, and must be subsequently processed to reduce the thickness to the desired value and to improve metallurgical properties. The mold-formed steel is usually characterized by a surface roughened by defects, such as cold folds, liquation, hot tears and the like which result primarily from contact between the mold and the solidifying metallic shell. In addition, the steel ingot or sheet thus cast also frequently exhibits considerable alloy segregation in its surface zone due to the initial cooling of the metal surface from the direct application of a coolant. Subsequent fabrication steps, such as rolling, extruding, forging and the like, usually require the scalping of the ingot or sheet prior to working to remove both the surface defects as well as the alloy deficient zone adjacent to its surface. These additional steps, of course, increase the complexity and expense of steel production.

Steel sheet thickness reduction is accomplished by a rolling mill which is very capital intensive and consumes large amounts of energy. The rolling process therefore contributes substantially to the cost of the steel sheet. In a typical installation, a 10 inch thick steel slab must be manipulated by at least ten rolling machines to reduce its thickness. The rolling mill may extend as much as one-half mile and cost as much as $500 million.

Compared to current practice, a large reduction in steel sheet total cost and in the energy required for its production could be achieved if the sheets could be cast in near net shape, i.e. in shape and size closely approximating the final desired product. This would reduce the rolling mill operation and would result in a large savings in energy. There are several technologies currently under development which attempt to achieve these advantages by forming the steel sheets in the casting process.

One approach under consideration by the steel industry to reduce processing involves roller casting of sheets of steel. This method was originally conceived by H. Bessemer over 100 years ago as described in British patent nos. 11,317 (1847) and 49,053 (1857) and a paper to the Iron and Steel Institute, U.K. (October 1891). This roller casting method produces steel sheets by pouring molten steel between counter rotating twin-rollers. The rollers are separated by a gap. Rotation of the rollers forces the molten metal through the gap between the rollers. Mechanical seals are necessary to contain the molten metal at the edges of the rollers. The rollers are made from a metal with high thermal conductivity, such as copper or copper alloys, and water-cooled in order to solidify the skin of the molten metal before it leaves the gap between the rollers. The metal leaves the rollers in the form of a strip or sheet. This sheet can be further cooled by water or other suitable means via jets. This method has the drawback that the mechanical seals used to contain the molten metal at the roller edges are in physical contact with both the rotating rollers and molten metal and therefore subject to water, leaking, clogging, freezing and large thermal gradients. Furthermore, contact between the mechanical seals and the solidifying metal can cause irregularities along the edges of sheets cast in this manner thereby offsetting the advantages of the roller method.

Accordingly, it is an object of the present invention to provide an improved method and arrangement for casting thin metal sheets.

It is another object of the present invention to produce thin metal sheets which require little or no subsequent rolling after the sheet is cast.

Yet another object of the present invention is to reduce the cost and complexity of casting thin material sheets.

A still further object of the present invention is to produce thin metal sheets using less energy.

Still another object of the present invention is to produce a metal product having good metallurgical properties and surface characteristics as it leaves the caster.

Another object of this invention is to provide for continuous roller casting of metal sheets.

It is still another object of this invention to provide containment of a pool of molten metal between twin-roller casters, without sidewalls that make physical contact with the rollers.

A further objective of this invention is to prevent a pool of molten metal from flowing out the ends of counter rotating rollers by means of a shaped horizontal alternating magnetic field.

A further objective of this invention is to provide an electromagnetic stopper or seal that is capable of preventing or regulating the flow of a molten metal in a horizontal direction.

An additional object of the present invention is to electromagnetically cast metal sheets with a minimum of electromagnetic heating of the molten and solid metal.

Another object of the present invention is to provide a system and method which is particularly adapted for the continuous casting of thin sheets of steel.

SUMMARY OF THE INVENTION

The present invention provides for confinement of molten metal with a horizontal alternating magnetic field. In particular, this invention employs a magnet that can produce a horizontal alternating magnetic field to confine a molten metal at the edges of parallel horizontal rollers as a solid metal sheet is cast by counter-rotation of the rollers.

DETAILED DESCRIPTION OF THE INVENTION

Figure 1A:
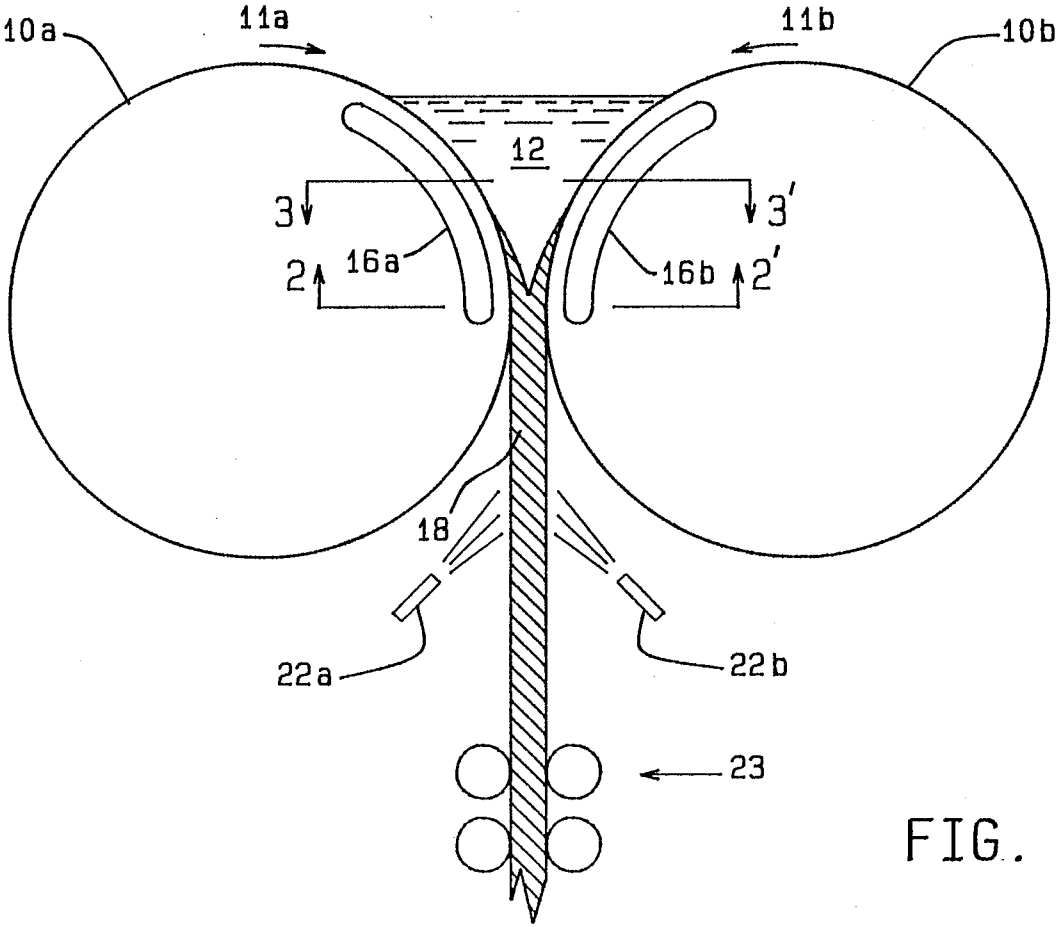
FIG. 1*a* is a cross sectional front view of the present invention.

The present invention overcomes the problems of roller casting with a novel design which features electromagnetic containment of the liquid metal at the roller edges in place of mechanical seals thereby overcoming the problems associated with mechanical seals. The present invention provides a shaped horizontal alternating magnetic field to confine a pool of molten metal between the cylindrical surfaces of a pair of rollers as the molten metal is cast into a thin vertical sheet by counter rotation of the rollers which force the molten metal between them. The horizontal alternating magnetic field of the present invention can also be used to prevent or regulate the flow of molten metal from weirs or orifices of other geometries. The pressure, p, exerted by the molten pool of metal consists essentially of ferrostatic pressure $p_h$ and pressure $p_r$ induced by the rollers via the solidifying metal to be cast $$p=p_h+p_r \quad (1)$$

The magnetic pressure, $p_m$, exerted by the horizontal alternating magnetic field, B, must balance the pressure from the top of the metal pool to the region where the shell of the metal has solidified sufficiently thick to withstand the pressure. The magnetic pressure is given by $$p_m=B^2/2\mu_o \quad (2)$$

where the constant $\mu_o$ is the permeability of free space.

The ferrostatic pressure $p_h$ exerted by the molten pool of metal increases linearly with increasing downward distance h from the surface of the pool $$p_h=g\rho h \quad (3)$$

where $\rho$ is the density of the metal and g is the acceleration of gravity. The magnetic field required to contain the ferrostatic pressure can be found by equating the magnetic and ferrostatic pressure, $$B=(2\mu_o g\rho h)^{12}=kh^{1/2}. \quad (4)$$

For casting steel k is approximately 450 if h is measured in cm and B in gauss.

The roller induced pressure $p_r$ depends on the properties of the metal being cast, the roller diameter and speed and the thickness of the metal strip or sheet being cast. In case of steel sheets, it is estimated that $p_r$ can be many times larger than the hydrostatic pressure $p_h$.

The frequency of the alternating magnetic field chosen is as low as practicable consistent with the distance between the rollers and the distance between the end of the rollers, typically between 30 Hz and 16,000 Hz.

FIG. 1*a* depicts a cross sectional view of the roller casting arrangement of the present invention. A pair of rollers 10*a* and 10*b* (referred to collectively as rollers 10) are parallel and adjacent to each other and lie in a horizontal plane so that a molten metal 12 can be contained between them above the point where the rollers are closest together. Rollers 10 are separated by a gap, d (shown in FIG. 2). Counter rotation of rollers 10*a* and 10*b* (in the direction shown by the arrows 11*a* and 11*b*), operating with gravity, forces the molten metal 12 to flow through the gap d between the rollers 10 and out the bottom.

Magnetic poles 16*a* and 16*b* located on both sides of the gap d between rollers 10*a* and 10*b* generate an alternating magnetic field which exerts an electromagnetic inward force that prevents the molten liquid 12 from flowing out the sides at the edges of the rollers 10*a* and 10*b*. Throughout this application references will be made to confinement at one end of a pair of rollers. It should be understood that confinement of molten metal between a pair of counter rotating rollers as provided by the present invention will be used at both ends of the pair of rollers.

Figure 1B:
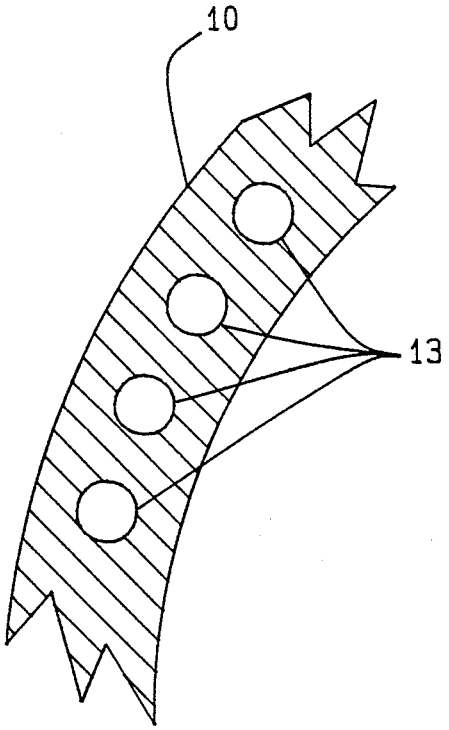
FIG. 1*b* is a sectional view of a segment of the roller in FIG. 1*a*.

Rollers 10 include a cooling means to cool and thereby solidify the molten metal by conduction as it passes between rollers 10. Referring to FIG. 1*b*, the cooling means may comprise a plurality of circulating water-cooled channels 13 located inside the surface wall of the roller. Referring again to FIG. 1*a*, after emerging from rollers 10, the metal has solidified into a sheet 18 having a thickness equal to the gap, d, between the rollers 10. Jets 22 located below the rollers further cool the cast metal sheet by spraying a coolant (such as water or air) on it. The cast metal sheet is guided, supported and carried away from the rollers by mechanical guides 23.

Figure 2:
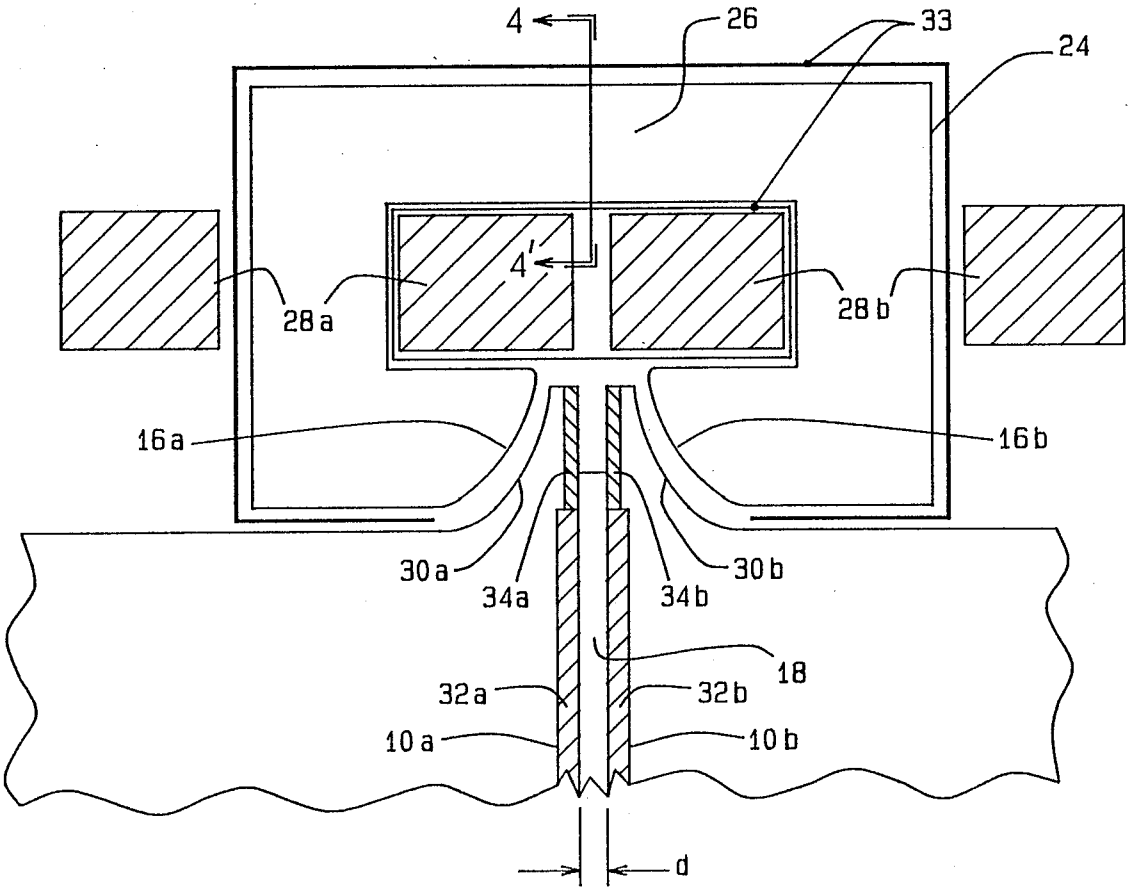
FIG. 2 is a view along section line 2–2′ of FIG. 1*a*.

Referring to FIG. 2, there is depicted a horizontal sectional view of the invention along section line 2–2′ of FIG. 1*a*. FIG. 2 depicts the arrangement of magnetic poles with respect to the rollers. Rollers 10*a* and 10*b* are separated by a gap, d, through which the metal being cast 18 can pass. Magnet 24 is comprised of a yoke 26 and poles 16*a* and 16*b*. Coils 28*a* and 28*b* wind around the magnet. Coils 28*a* and 28*b* carry an electric current supplied by an alternating current source thereby magnetizing the magnet 24 and inducing a magnetic field between poles 16*a* and 16*b*. The major portions of magnetic poles 16*a* and 16*b* are located inside the outer edges 30*a* and 30*b* of the rollers. The magnetic poles 16*a* and 16*b* are stationary and radially separated from the rollers 10*a* and 10*b* by a space clearance large enough to allow free rotation of the rollers 10. The poles 16 extend axially into the ends of the rollers 10 a short distance.

The cylindrical surfaces of rollers 10 have a middle portion 32 which comes in contact with the molten metal. The middle portions 32 are constructed of a material which has high thermal conductivity so that a cooling means, used in conjunction with the rollers, can remove heat from the molten metal thereby facilitating the casting process. In the present embodiment, the cooling means used in conjunction with the rollers comprises water cooled channels 13 in the interior of rollers 10 as shown in FIG. 1*b*. In this embodiment, the middle portions 32 of rollers 10 are made of copper alloy.

The rollers 10 also have outer rims 34*a* and 34*b* which form extensions of middle portions 32 of rollers 10. Rims 34 are located in the area between the magnetic poles 16. Poles 16 generate a magnetic field that penetrates through the rims 34 of rollers 10 in this embodiment. Therefore, for this embodiment rims 34 must be made of a material suitable for the transmission of a magnetic field. In this embodiment of the present invention, the rims are made of stainless steel.

The resistivity of stainless steel (approximately 75 micro-ohm-cm at room temperature) matches reasonably the resistivity of molten steel (approximately 140 micro-ohm-cm); therefore, the horizontal magnetic flux can penetrate both metals. Due to eddy currents in the molten metal, the field decays exponentially as the axial distance, z, from the edge of the pool increases. Therefore, a magnet force $F_1$ at the pool edge is larger than the oppositely directed force $F_2$ further into the pool, as shown in FIG. 3, resulting in a net containing force F $$F = 1/\mu o \int_{z_1}^{z_2} B \frac{\gamma B}{\gamma z} dz \quad (5)$$

As a result, the molten metal can be contained between the rollers.

Figure 4:
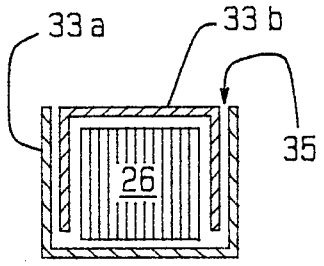
FIG. 4 is a cross sectional view of the core as depicted along section line 4–4′ of FIG. 2.

Referring again to FIG. 2, the edges 30 of rollers 10 are curved and tapered on their interior portions to accommodate the magnetic poles 16. Likewise poles 16 generally conform in shape to the exterior portion of the rollers 10. Shield 33 encloses yoke 26 and portions of poles 16 except for the pole ends. Yoke 26 may be made of a laminated core. Shield 33 encloses the core 26 without forming an electrically shorted turn as illustrated by FIG. 4. The shield 33 may be formed by two U-channels 33*a* and 33*b* made from copper sheets and insulated from each other by at least one gap 35. Shield 33 should be made of a material with low resistivity to prevent transmission of a magnetic field by means of eddy current shielding and thereby serve to reduce flux leakage, enhancing shaping the magnetic field and improve circuit efficiency. Shield 33 may also serve as a heat shield for the magnet and may be water cooled for this purpose. A material with low resistivity and high thermal conductivity, such as copper or copper alloy, is ideal for use as shield 33.

Figure 3:
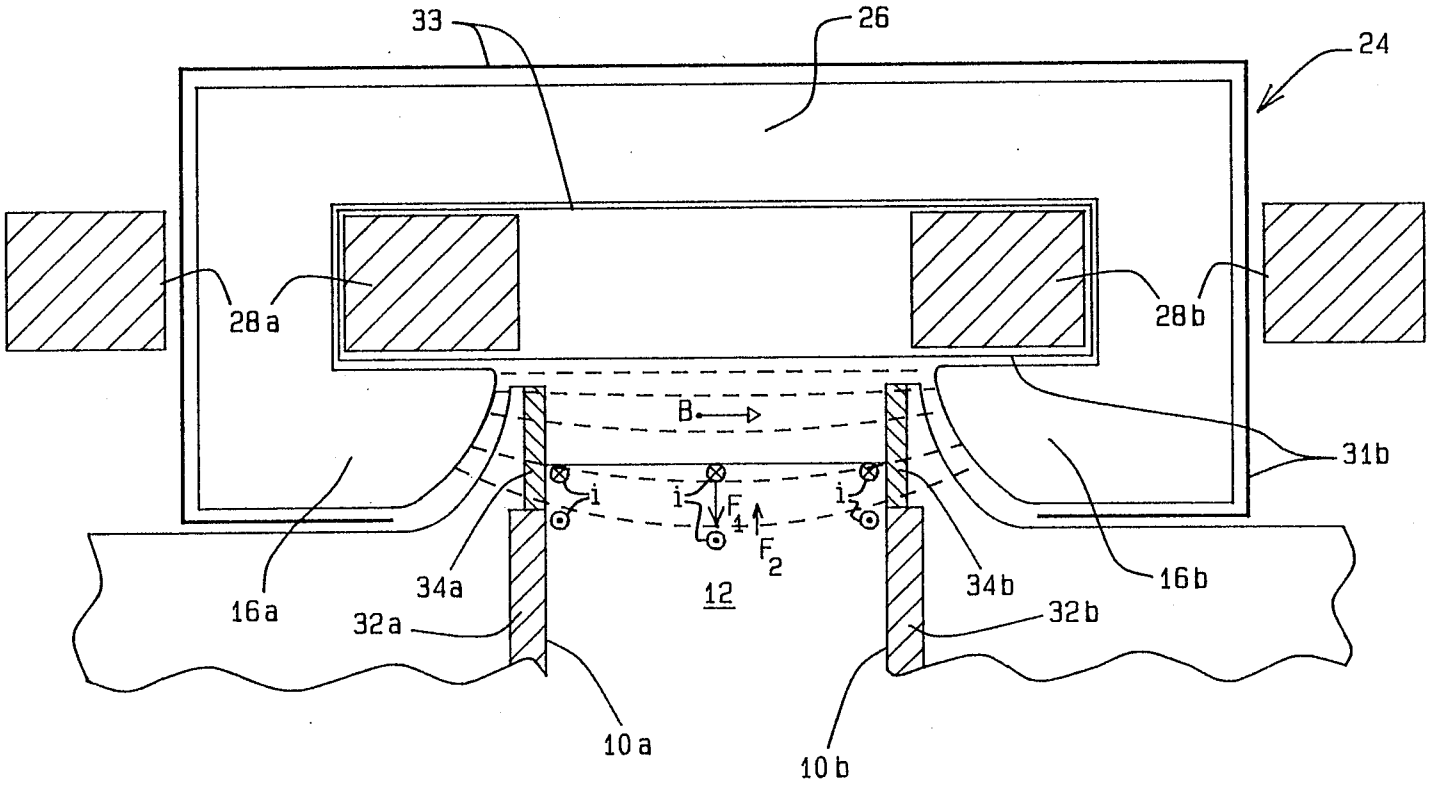
FIG. 3 is a view along section line 3–3′ of FIG. 1*a*.

Referring to FIG. 3, there is depicted a horizontal cross section of the present invention as viewed along section line 3–3' of FIG. 1*a*. FIG. 3 depicts a section between the rollers at a point displaced vertically from the horizontal axes of the rollers 10. FIG. 3 shows containment of the molten metal 12 by the rollers 10 and the interaction of magnetic field, B, and eddy currents i. FIG. 3 depicts rollers 10 having middle portion 32 and rims 34. Also shown in FIG. 3 is the magnet 24 having a yoke 26, poles 16 coil 28 and shield 33.

FIG. 3 also depicts molten metal 12 retained between the ends of rollers 10 by the magnet field, B (shown as the dashed lines), between poles 16. The magnetic field, B, causes eddy currents, i, in the molten metal, indicated by arrow heads out of the page and arrow tails into the page, and a resultant electromagnetic force, F, directed toward the interior of the pool to contain the molten metal. The containment forces, F, are due to the interaCtion of the horizontal field, B, with the eddy currents, i, in the molten metal, induced in the molten metal by the magnetic field, B.

Figure 5:
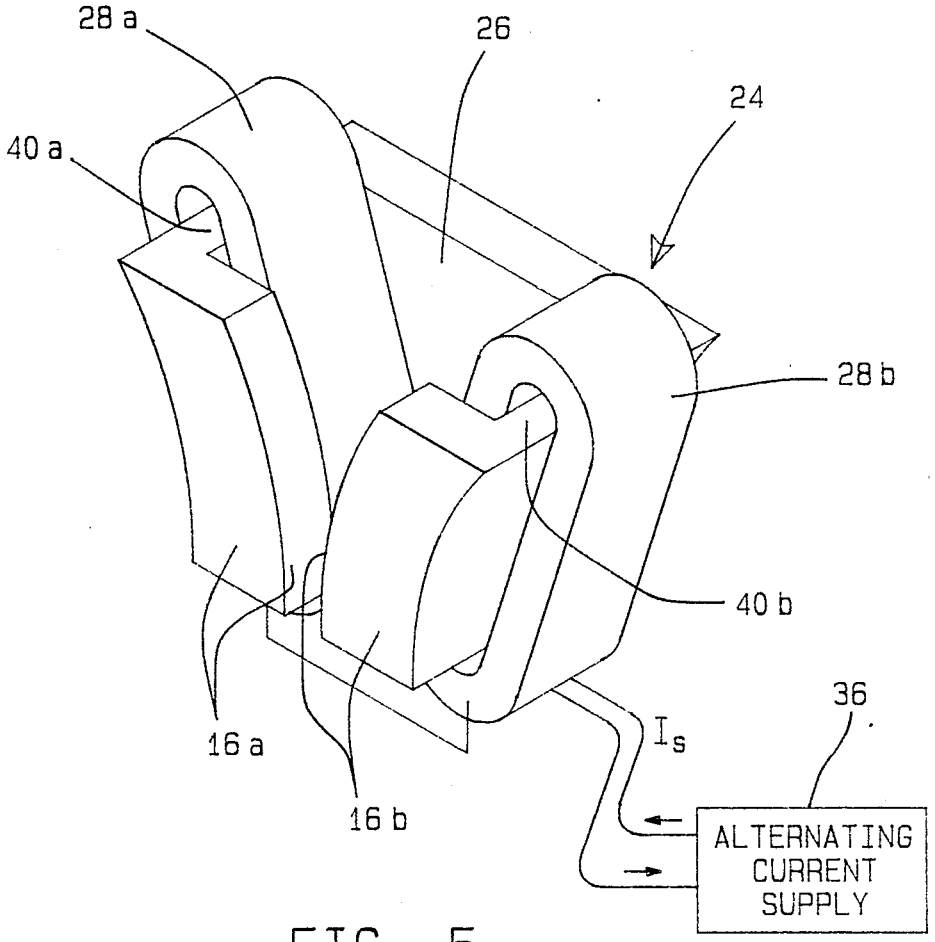
FIG. 5 is a perspective view of the magnet and coil of one embodiment of this invention.

In the present invention, a number of different magnet and coil geometries can be employed to adapt to particular requirements of the casting process. FIG. 5 is an perspective view of the magnet 24 and coil 28 as depicted in FIGS. 1–4. The magnet has laminated yoke 26 and poles 16*a* and 16*b*. The poles 16 are arced in shape and may conform to the shape of the interior portions of rollers 10. The coil comprises a coil pair 28*a* and 28*b* which encircle laminated core portions 40*a* and 40*b* of magnet 24. Coils 28 are connected to an alternating current supply 36 which provides an alternating current, $I_2$, which energizes the magnet 24. The pair of coils may be connected in series to the current source or in parallel depending upon design considerations. For simplicity, the eddy current shield around the magnet is not shown.

Figure 6:
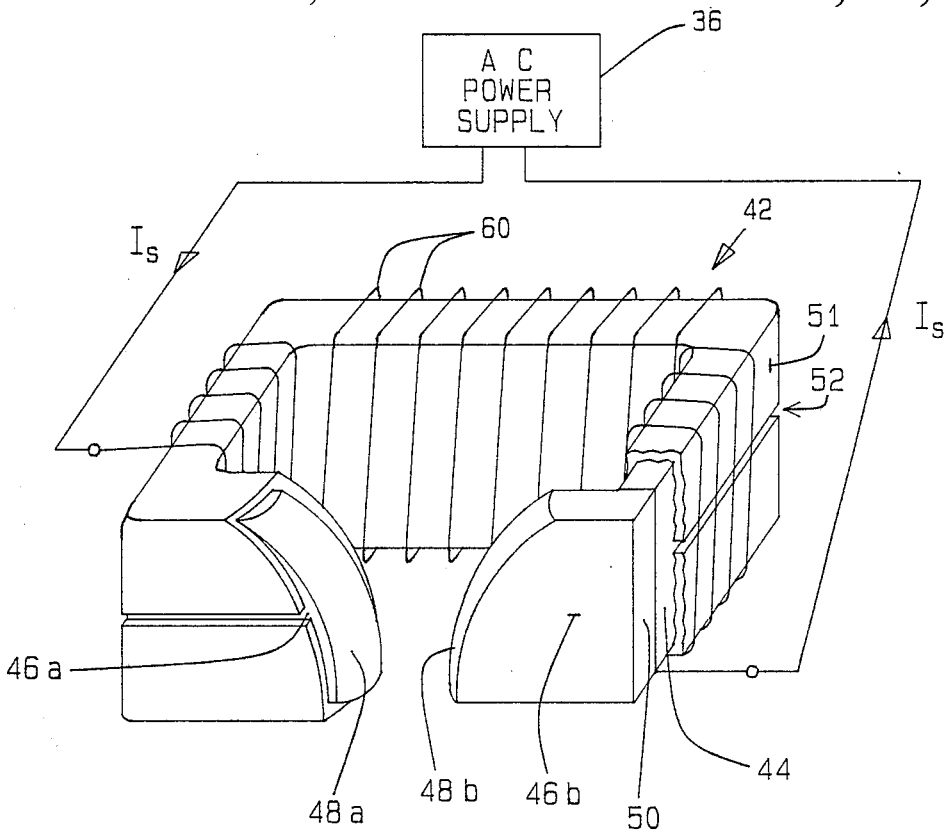
FIG. 6 is a perspective view of another embodiment of the magnet and coil of this invention.
Figure 7:
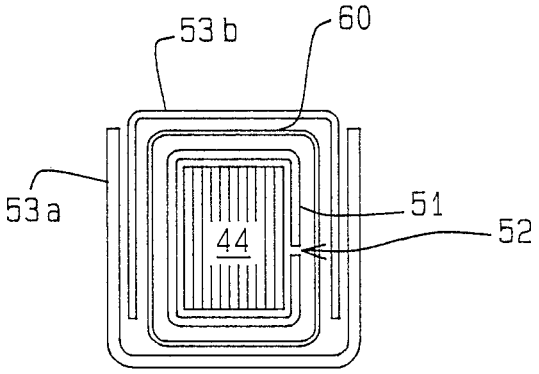
FIG. 7 is a cross section of the yoke as depicted in FIG. 6.

Another embodiment of the magnet and coil is depicted in FIG. 6. In this embodiment, the magnet 42 has a square shaped core 44 connecting poles 46*a* and 46*b*. Poles 46*a* and 46*b* in this embodiment have shaped pole faces 48*a* and 48*b* but squared off backs 50 to conform to the square shape of the core 44. As illustrated by the cutaway view of pole 46*b*, an insulated copper shield 51 encloses the core to reduce leakage flux. A gap 52 in the shield 51 prevents the shield from being a shorted turn around the magnet core. Coil 60 encircles core 44 and shield 51. In this embodiment, the coil 60 is a single layer coil instead of a coil pair as in the previous embodiment. Coil 60 is connected to a alternating current supply 36 which provides an alternating current, $I_s$, which energizes the magnet 42. The leakage flux could be reduced further by also enclosing the coil 60 with a copper shield 53*a* and 53*b* as depicted in FIG. 7. This additional shield 53*a* and 53*b* would reduce the cross sectional area available in the air space for the leakage flux around the coil windings and thereby reduce such leakage flux. In still another embodiment, the inner shield 51 could be deleted and the core and coil assembly enclosed by only an outer shield 53.

Figure 8:
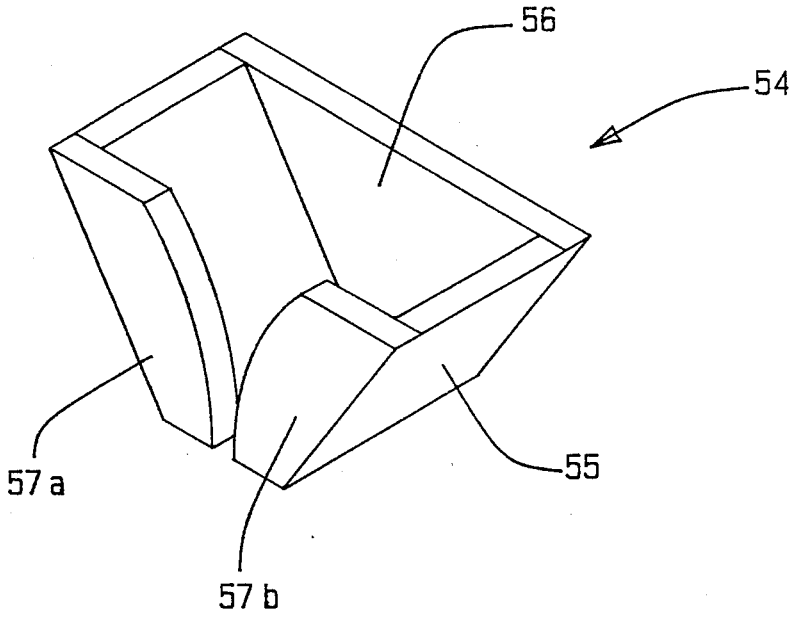
FIG. 8 is a perspective view of another embodiment of the magnet core of this invention.

FIG. 8 depicts another variation of the magnet used in the present invention. In this embodiment, magnet 54 has a generally truncated trapezoidal shaped core with rectangular flat arms 55 connecting the trapezoidal yoke 56 to the poles 57*a* and 57*b*. Similar to the magnet design in FIG. 5, this magnet may have the advantage of being simpler to construct.

Figure 9:
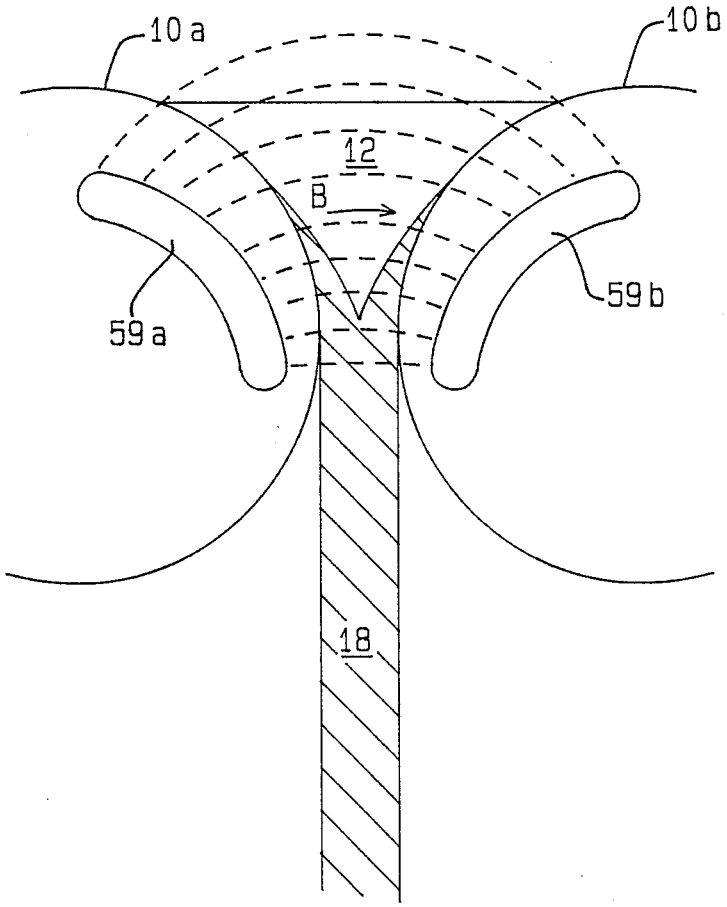
FIG. 9 is a front sectional vertical front view of another embodiment of this invention.

A further modification to the magnet is depicted in FIG. 9. In FIG. 9, a molten liquid 12 is being cast into a sheet 18 between rollers 10. As in the previous embodiments, magnet poles 59*a* and 59*b* confine the molten metal at the edges of the rollers 10. In this embodiment, the magnetic poles 59 are adjustable in position. The poles 59*a* and 59*b* can be slanted and moved to be closer to or further away from the roller rims. This feature enables adjustment of the magnetic field. As depicted in FIG. 9, the upper parts of the poles 59 have been moved further away from the roller rims as compared to the bottom part of the poles. As shown by the dashed lines representing the magnetic field B in FIG. 9, with the top ends of poles 59 further apart, the magnetic field can be made relatively stronger near the lower end and weaker at the higher end as compared to the pole configuration shown in FIG. 1*a*. This adjustability can be utilized for casting metal sheets of different thicknesses where different forces of confinement may be necessary.

Figure 10:
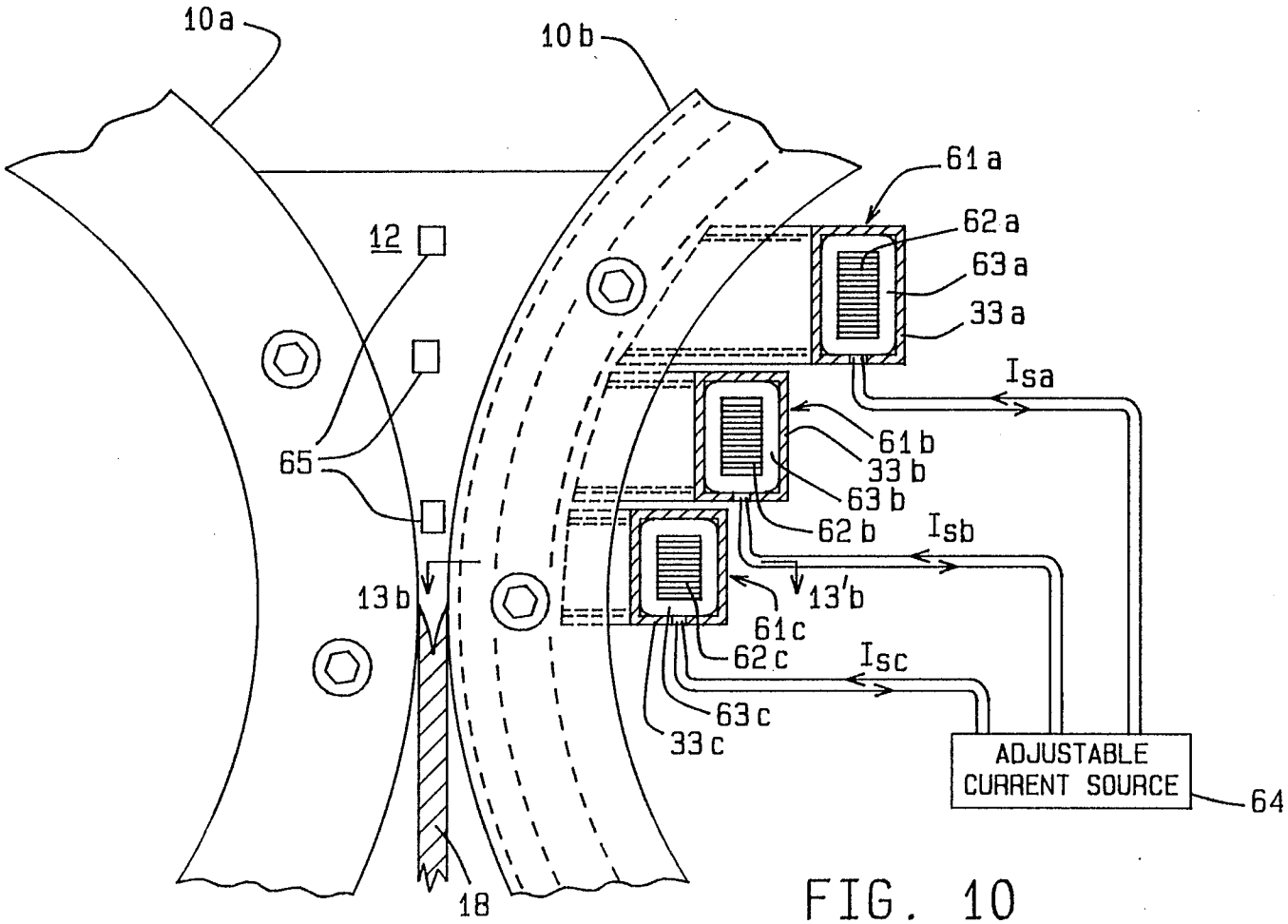
FIG. 10 is a vertical sectional front view of still another embodiment of the magnet of this invention and a sideview of the rollers.

FIG. 10 shows still another variation of the magnet in the present invention. This variation offers the most flexibility of any of the designs shown so far. (FIG. 10 depicts just one magnet pole; it should be understood that an identical pole would be positioned opposite this pole in the other roller.)

In FIG. 10, each magnet pole is divided into three discreet separate magnetic elements 61*a*, 61*b*, and 61*c*. Each of these elements is an independent magnet comprising cores 62, excitation coils 63, and eddy-current-shields 33, which enclose their respective coils and cores, except for an air gap which prevents the shields from becoming a shorted turn such as depicted in FIGS. 4 or 7. Magnetic element 61*a* contains the upper portion of the sidewall of the molten metal pool 12, element 61*b* contains the center of the pool sidewall and element 61*c* contains the lower portion of the pool sidewall.

In this embodiment, each individual discreet magnetic element is individually controlled and provided with individual currents, $I_{sa}$, $I_{sb}$, and $I_{sc}$. These three magnetic elements may be energized from a single alternating current power source 64 or from three individual power sources. With a single power source, two variable reactors would be connected in series with the coils of two of the three magnetic elements in order that the magnetic fields of the three magnetic elements can be adjusted independently; the time constant (L/R) of the reactors is designed to be the same as the time constant of the magnets in order that the flux generated by the three independent magnets is in phase. With three independent power sources, care must be taken that the three sources have the correct phase relation. Because each element can be individually adjusted there is provided a high degree of adjustability for the total magnetic field as well. This adjustability can be utilized to optimize operation under varying conditions, such as with different sheet thicknesses, different molten metals or alloys, different temperature conditions, start-up and shut-down.

Feedback loops can utilize sensors 65 to monitor the position of the upper, middle and lower portions of the electromagnetically contained sidewall. Any deviation from a present position will produce an error signal which, after suitable amplification, will change the power supplied to the respective magnetic elements in order to restore the preset containment position of the respective sidewall portion. These sensors may take the form of discreet beams (rays) that are transmitted parallel to the sidewall from one side and detected by a receiver on the other side (the beam being interrupted when the sidewall moves closer to the magnet). Alternately, the sensors may take the form of discreet beams that are transmitted normal to the sidewall and their reflection from the surface of the sidewall being detected by a receiver and used to determine the position of the sidewall. The sensors may take the form of variable capacitors where the monitored sidewall portion is one electrode of the capacitor and the other is a suitable electrode mounted a fixed distance and in parallel to the sidewall. In a still further alternative, the sensor may take the form of an impedance measurement of the magnet excitation which changes with the flux linkage between the magnet and the liquid metal of the respective sidewall portion.

Figure 11:
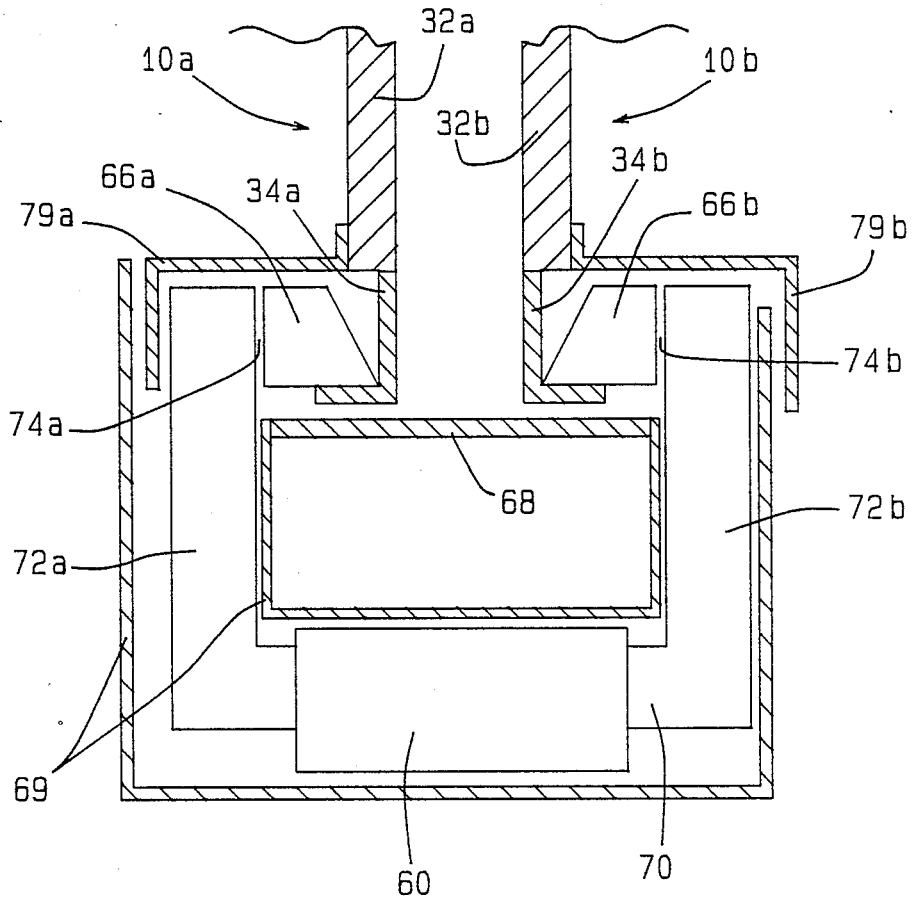
FIG. 11 is a horizontal sectional view of another embodiment of this invention.

A still further embodiment of the magnet design is depicted on FIG. 11. FIG. 11 depicts a horizontal sectional view of one end of one roller pair. In this embodiment the pole assemblies 66*a* and 66*b* are hoop-shaped and contained inside and attached to the rollers 10*a* and 10*b* behind rims 34*a* and 34*b*, respectively. Accordingly, poles 66 will rotate with rims 34 and rollers 10. Portion 68 of shield 69 is located between core sections 72*a* and 72*b* and close to the area where the casting takes place. Poles 66*a* and 66*b* are circular and made of a ferromagnetic material. The coil 60 magnetizes yoke 70 and magnet arms 72*a* and 72*b* as in the previous embodiments. Eddy current shields 69 and 79 confine the magnetic flux to the yoke 70, magnet arms 72 and poles 66 (reducing leakage flux) as described earlier. Shields 69 and 79 may also incorporate heat shielding or cooling means to protect the coil or the magnet. Poles 66*a* and 66*b* though separated from magnet arms 72*a* and 72*b* and rotating with rollers 10*a* and 10*b*, are magnetized by their close proximity to arms 72*a* and 72*b* via relatively small gaps 74*a* and 74*b*. This embodiment has the advantage that the poles can be located as close together as physically possible, i.e. inside the rims. This design simplifies the shape of the magnet yoke and permits the use of different magnet yokes and coils when the assembly of rollers 10 and poles 66 is used to cast different thicknesses of metal sheets. Casting sheets, i.e. 0.4" thick would utilize a more powerful magnet assembly than casting 0.04" thick metal sheets.

As described previously and shown in FIGS. 2, 3, and 11, the magnetic field penetrates through the outer rim portion of the rollers to confine the molten metal. The present invention can also be practiced without a special rim portion provided a suitable material is used for the rollers, such as a ceramic, which enables penetration by a magnetic field without generating eddy currents in the roller. However, in the preferred embodiment, use of a rim portion on the rollers provides for shaping the magnetic field by establishing a well defined transition from the area of a high magnetic flux near the edge of the roller to an area of low magnetic flux further away from the roller's edge. Shaping the magnetic field in this manner provides the advantages of better control of the magnetic field that contains the sidewall of the molten pool of metal.

The present invention provides for shaping the magnetic field by using a material with a low resistivity, such as copper or copper alloy, for the main portion of the roller and a material with a higher resistivity for the rim portion. The copper or copper alloy used for the main portion will effectively prevent penetration of the magnetic field (except for a small negligible skin layer on the surface) and will, at the same time, cool the molten metal efficiently causing it to solidify.

In the rim portion of the roller, it is essential to allow penetration of the magnetic field to confine the sidewall of the molten metal between the two roller surfaces. The present invention includes several different embodiments of the rim portion designed to allow penetration of the magnetic field. In one embodiment, this is accomplished by connecting a rim made of a material with a much higher resistivity, such as stainless steel, to the edges of the copper rollers. FIGS. 2, 3 and 11 depict stainless steel rims 34 of this type. The stainless steel rims may be connected to the copper rollers by brazing, bolting or other suitable methods. In addition to allowing penetration of the magnetic field, the stainless steel rims provide a smooth surface for the casting surface in case the molten metal encroaches on the rim.

Figure 12A:
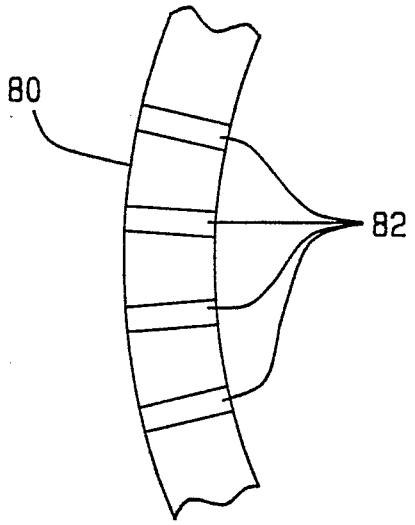
FIG. 12*a* is a front view of a portion of another embodiment of the roller rim of this invention.
Figure 12B:
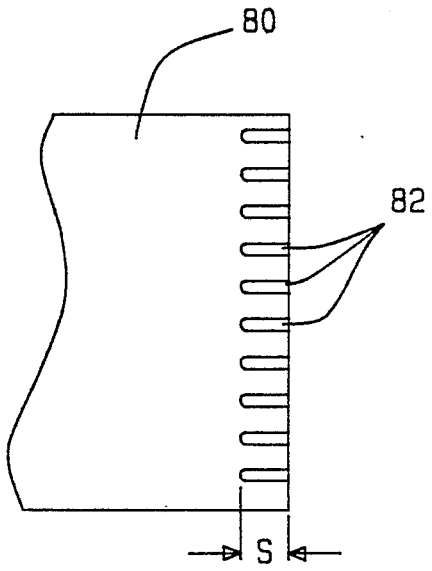
FIG. 12*b* is a top view of the embodiment of the roller rim of this invention as depicted in FIG. 12*a*.

Another embodiment of the rim portion is depicted in FIGS. 12*a* and 12*b*. The roller 80 is made of a low resistivity material such as copper. At the edges around the circumference of the rollers are a plurality of slots 82 all the way through the roller. The slots 82 extend a short distance, s, in the axial direction of the roller. The slots 82 permit the magnetic flux in the edge portion, or rims of the rollers, defined by the slots. Although the slots can be left empty, it is preferred that the slots be filled with a material of relatively high resistivity such as ceramic or stainless steel which is insulated from the sides of the slots, or filled with a material of high magnetic permeability. Alternatively, the slots can be filled with laminations of high permeability metal which are insulated from each other and from the sides of the slots. Leaving the slots empty would require that the magnetic field is shaped such that the molten metal is kept away from the slots at all times. Filling the slots provides a smooth surface in case the molten metal encroaches on part of the rim during the casting process. Slot dimensions can be determined based upon the application. An advantage of the slotted copper rim design is that it features a low reluctance path for the magnetic flux, i.e. the slots, filled with highly permeable material or with air, thereby enabling a high frequency alternating magnetic field. For example, whereas the roller design with stainless steel rims can operate at relatively low frequencies, e.g. up to 500 Hz, the roller design with slotted rims can operate with a much wider frequency range, e.g. up to at least 16 kHz.

Figure 13A:
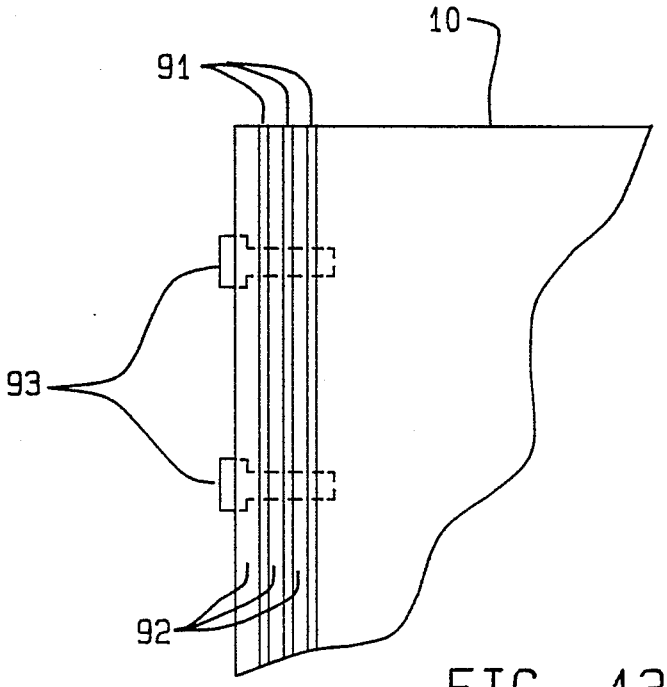
FIG. 13*a* is a view of a portion of a roller showing another embodiment of the roller rim of this invention.
Figure 13B:
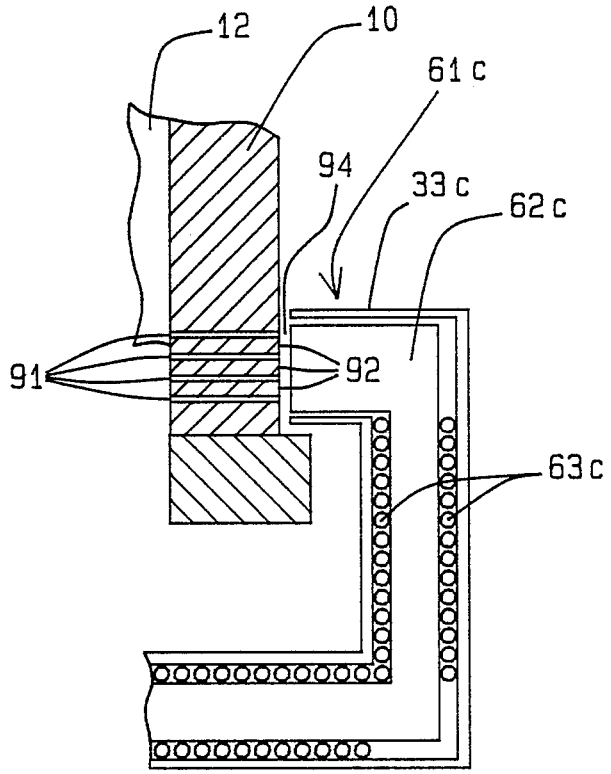
FIG. 13*b* is a sectional view along line 13*b*–13*b*′ of FIG. 10.

Other embodiments of the rim portion are shown in FIGS. 13*a* and 13*b*. FIG. 13*b* is a horizontal cross section along line 13*b*–13*b*′ of FIG. 10. The water-cooled rollers 10 are made of high thermal conductivity material such as copper. At the edges and around the circumference of the rollers are one or more hoop-shaped extensions 91 of rollers 10. Arranged between these hoop-shaped extensions 91 are similar hoop-shaped members 92 made of copper. These hoops, 91 and 92, are insulated from each other and mounted to the rollers 10 with bolts 93. The bolts 93 are insulated from the hoops to prevent electrical contact between the individual hoops and between the hoops and the roller. The hoop-shaped extensions 91 serve the same purpose as the slots 82 in the previous embodiment, i.e. to transmit the magnetic field to the confinement region. Extensions 91 can be made of similar materials as slots 82. Extensions 91 can be made of an insulating material, such as ceramic, having a high resistivity and relatively low permeability and, therefore, no eddy currents. Extensions 91 can be made of a non-magnetic, high resistively metal, such as stainless steel, which also has relatively low permeability, but has higher thermal conductivity than ceramic. Alternately, extensions 91 can be made of a magnetic material, such as silicon steel, which has high magnetic permeability and reasonable thermal conductivity. With a high permeability material the hoop-shaped extensions themselves become magnetized. Thin insulated laminations of a ferromagnetic material could be used. With hoop-shaped extensions of stainless steel or ferromagnetic material, each hoop should be insulated from adjacent copper hoops. The alternating flux emanating from the magnet pole penetrates the roller through the hoops 91 and through the skin depth of the copper hoops 92. A portion of this flux induces eddy currents in the molten metal 12 between the rollers. The interaction between the flux and the eddy currents in the molten metal contains the sidewall of the molten metal pool between the rollers as described before. The thickness of the hoop-shaped extensions 91, the number of hoop-shaped extensions, the hoop-shaped extension material, and the magnet are designed to contain the sidewalls of the molten pool between the rollers. With the hoop-shaped extension made from highly permeable magnetic material, the electromagnetic containment circuit is most efficient. In this case the reluctance of the magnetic circuit is mainly determined by the reluctance of the molten metal 12 and by the small air gap, 94, between hoops 91 and magnet pole 61*c*; all other designs have much larger air gaps and resultant larger leakage flux.

Figure 14:
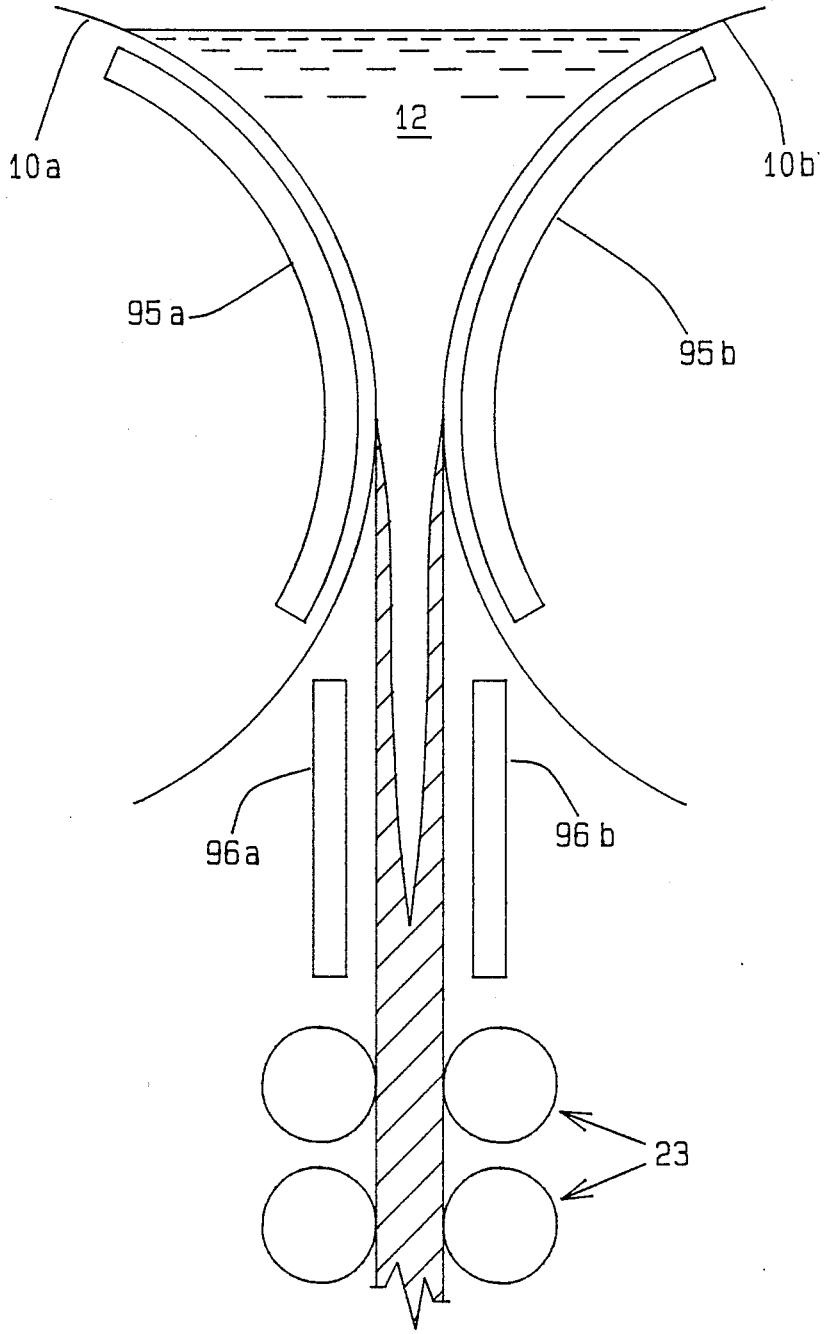
FIG. 14 is a side view of another embodiment of this invention.

Another embodiment of this invention is shown in FIG. 14. This embodiment of the invention may be used where conditions are such that the edge of the cast metal sheet is not fully solidified by the time it exits from between the rollers. This condition may occur for a number of reasons dictated by the casting process, such as the need for high magnetic fields of relatively high frequency resulting in large eddy current heating of the edges of the metal being cast, insufficient cooling effect of the rollers near the edges, thick cast sheet dimensions, or a combination of these or other factors. FIG. 14 depicts the rollers 10 and molten metal 12 as in previous embodiments. FIG. 14 also shows poles 95*a* and 95*b* which extend below the center line of rollers 10. This has the effect of also extending the magnetic field below the center line of the rollers thereby extending the electromagnetic containment of the edges.

Wheel induced forces on the liquid edge of the metal sheet vanish when the sheet leaves the rollers. Only gravitational forces act on the still molten edges which may be cooled by gas flow or by water spray. The magnetic forces between poles 95 decrease as the sheet moves further from the rollers; this is compatible with the solidifying edge as the sheet moves down. However, if the edge of the sheet is not quite solid near the end of the magnetic field between poles 95, further confinement of the still molten edges of the sheet can be provided by supplemental magnet with poles 96*a* and 96*b* which extend the magnetic field well below rollers 10 until the metal sheet is sufficiently hard enough to be supported by mechanical guides 23.

Figure 15A:
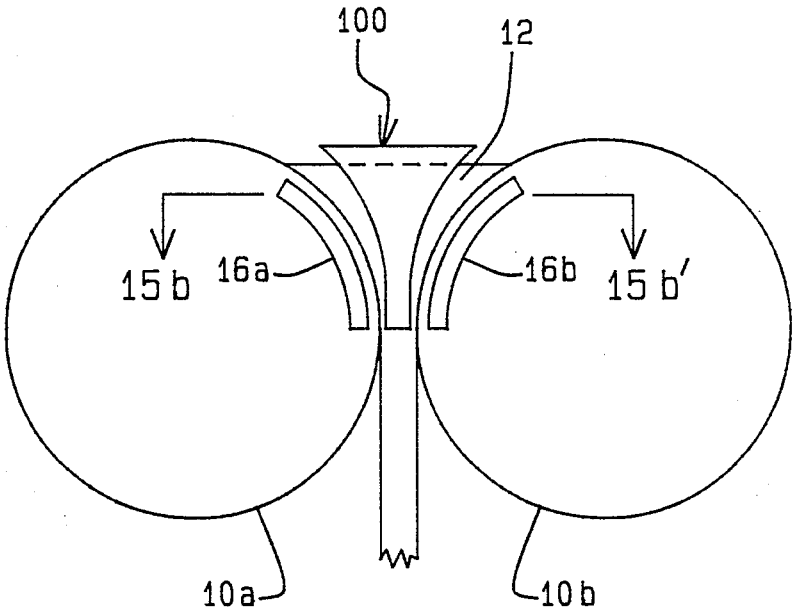
FIG. 15*a* is a side view of still another embodiment of this invention.
Figure 15B:
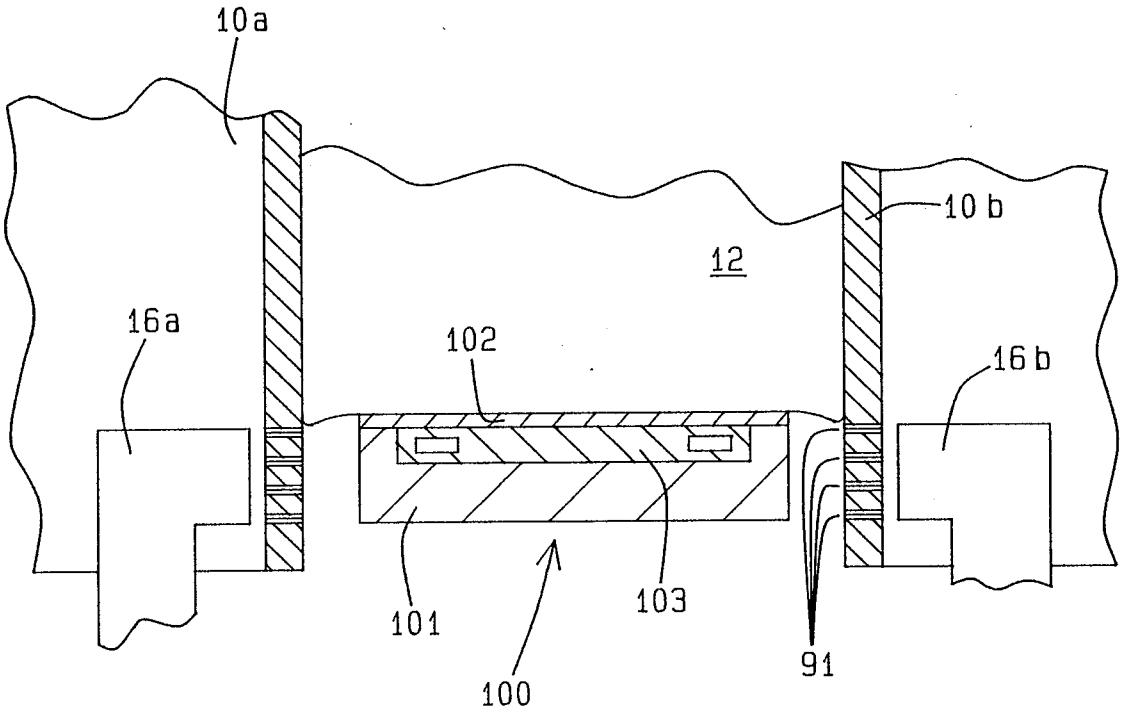
FIG. 15*b* is a horizontal view along line 15*b*–15*b*′ of FIG. 15*a*.

Another embodiment of this invention is depicted in FIGS. 15*a* and 15*b*. This embodiment presents a combination of a magnetic and mechanical means to contain a molten metal at the edges of a roller casting system. As mentioned above, the problem of using mechanical seals to contain a molten metal at the edges of counter-rotating casting rollers was that the mixture of the molten and solidifying metal in combination with the rotation of the rollers would clog up around the mechanical seals. As described above, the present invention shows how a magnetic field can be used to contain the sidewalls of the molten metal. The present embodiment uses both a mechanical seal and a magnetic field to advantage. As in previous embodiments, rollers 10 and poles 16 contain a molten metal 12. The present embodiment also includes a mechanical dam 100 positioned between poles 16*a* and 16*b*. Mechanical dam 100 is shaped so that it will contain the molten metal in that area where there is little likelihood of clogging or deforming the cast sheet, i.e. away from the solidifying effects of the rollers. As depicted in FIGS. 15*a* and 15*b*, mechanical dam 100 is spaced away from rollers 10. It is in the areas close to rollers 10 that the metal is solidifying and where the likelihood of clogging is greatest. Magnetic confinement with the poles 16 is used to confine the molten and solidifying metal in the gaps between the mechanical dam 100 and rollers 10. Mechanical dam 100 may be made of a ferromagnetic material 101 so that it provides a low reluctance path for the flux between the poles 16. The side of the dam facing the molten metal pool may be made of a layer of high temperature ceramic 102 covering a water cooled heat shield 103 in front of the high permeability material which may be made from steel laminations or from high temperature ferrite. This embodiment has the advantage of requiring less energy than the previous embodiments because the magnetic field along the molten metal extends only over the gaps between the rollers 16 and mechanical dam 100. Also, because the volume of the molten metal contained by the magnetic field is smaller, there is less heating of the molten metal due to eddy currents. Various mechanical dam shapes can be designed for shaping flux density suitable for different casting requirements.

The embodiments of this invention in which an exclusive property or privilege is claimed are defined as follows:

1. An apparatus for confining molten metal comprising:

containment means having an open side;

a magnet capable of generating a mainly horizontal alternating magnetic field, said magnet located adjacent to the open side of said containment means whereby the field generated by said magnet is capable of inducing eddy currents in a thin layer at the surface of the molten metal which interact with the magnetic field producing a force that can contain the molten metal within said containment means;

wherein said magnet includes:

magnetic poles located adjacent to the open side of said confinement means;

a core connecting said poles;

a coil encircling said core, said coil capable of being responsive to a current source;

whereby an alternating magnetic field can be generated between said poles and parallel to the open side of said containment means so that a molten metal can be confined within said confinement means.

2. The apparatus of claim 1 in which said containment means comprises:

a pair of rollers parallel and adjacent to each other in a horizontal plane and further wherein said rollers are separated by a gap;

whereby counter rotation of said rollers can force the flow of a molten metal between the gap between said rollers.

3. The apparatus of claim 3 in which said magnetic poles extend axially into the ends of said pair of rollers.

4. An apparatus for confining molten metal comprising:

containment means having an open side comprising a pair of rollers each of said rollers including a middle portion and a rim portion, wherein said rollers are parallel and adjacent to each other in a horizontal plane and further wherein said rollers are separated by a gap, whereby counter rotation of said rollers can force the flow of a molten metal between said gap between said rollers, a magnet located adjacent to said open side of said containment means comprised of magnetic poles located adjacent to said open side of said containment means and extending axially into the ends of said rollers, a core connecting said magnetic poles, a coil encircling said core, said coil capable of being responsive to a current source, whereby an alternating magnetic field can be generated between said poles and parallel to said open side of said containment means so that a molten metal can be confined within said containment means, in which said middle portions of said rollers have a resistivity lower than said rim portions so that transmission of a magnetic field by said magnet through said middle portion is less than through said rim portion.

5. The apparatus of claim 4 in which said rim portions of said rollers are between said magnetic poles.

6. The apparatus of claim 5 including:

roller cooling means for cooling the surfaces of said rollers whereby molten metal coming in contact with said rollers will tend to solidify.

7. The apparatus of claim 6 in which said middle portions of said rollers have surfaces of copper or a copper-alloy.

8. The apparatus of claim 6 in which said rim portions of said rollers are stainless steel.

9. The apparatus of claim 6 in which said rim portions of said rollers have slots spaced around the circumference of said rim portion, said slots having lower reluctance to alternating magnetic flux than said middle portion of said rollers so that said magnet can generate a magnetic field between said rim portion.

10. The apparatus of claim 9 in which said slots are filled with a ceramic.

11. The apparatus of claim 9 in which said slots contain a high resistivity metal, said high resistivity metal being insulated from the sides, of said slots.

12. The apparatus of claim 11 in which said slots contain stainless steel.

13. The apparatus of claim 9 in which said slots are filled with laminations of a high permeability metal, said laminations being insulated from each other and from the sides of said slots whereby the high permeability metal contained in said slots is capable of being magnetized by said magnets.

14. The apparatus of claim 6 in which said rim portions are comprised of a plurality of rim hoops of a material having lower reluctance to alternating magnetic flux than said middle portion of said rollers, each of said plurality of rim hoops separated from a adjacent rim hoop by a hoop of material having higher reluctance to alternating magnetic flux.

15. The apparatus of claim 14 in which said plurality of rim hoops are made of ceramic.

16. The apparatus of claim 14 in which said plurality of rim hoops are made of a high resistivity metal, said plurality of rim hoops being insulated from adjacent hoops and said middle portion.

17. The apparatus of claim 16 in which said plurality of rim hoops are made of stainless steel.

18. The apparatus of claim 14 in which said plurality of rim hoops are made of a high permeability metal, said plurality of rim hoops being insulated from adjacent hoops and said middle portion whereby the high permeability metal is capable of being magnetized by said magnet.

19. The apparatus of claim 6 in which said magnetic poles are adjustable whereby the shape of the magnetic field between said magnetic poles can be varied.

20. The apparatus of claim 6 in which said magnetic poles are movable whereby the shape of the magnetic field between said magnetic poles can be varied.

21. The apparatus of claim 6 in which said magnetic poles are comprised of a plurality of isolated segments each of said plurality of isolated segments being independently adjustable as to magnetic field strength whereby the shape of the entire magnetic field between said magnetic poles can be varied.

22. The apparatus of claim 19 including a sensor means constructed and adapted to monitor the dimensions or position of a metal pool being cast between said rollers.

23. The apparatus of claim 22 in which the field strength of said magnetic poles is adjustable in response to said sensor means.

24. The apparatus of claim 6 in which said magnetic poles are hoop shaped and rigidly affixed to the interiors of said rollers inside said rims and further wherein said magnetic poles are aligned in proximity with but do not touch said core so that said magnetic poles can be magnetized by said core.

25. The apparatus of claim 6 in which said core is trapezoidal in shape.

26. The apparatus of claim 6 in which said core is square in shape.

27. The apparatus of claim 6 in which said coil is comprised of a pair of coils encircling said core on extensions which connect to said magnetic poles.

28. The apparatus of claim 1 including a first eddy current shield enclosing said core except for a gap to prevent said first eddy current shield from being a shorted turn.

29. The apparatus of claim 28 in which said first eddy current shield is made of a low resistivity metal.

30. The apparatus of claim 29 in which said first eddy current shield is made of a metal selected from a group consisting of copper, copper alloy, and aluminum.

31. The apparatus of claim 6 including a second eddy current shield enclosing said core and said coil except for a gap to prevent said second eddy current shield from being a shorted turn.

32. The apparatus of claim 31 in which said second eddy current shield is made of a low resistivity metal.

33. The apparatus of claim 32 in which said second eddy current shield is made of a metal selected from a group consisting of copper, copper alloy, and aluminum.

34. The apparatus of claim 6 including a first eddy current shield enclosing said core and said coil except for a gap to prevent said first eddy current shield from being a shorted turn.

35. The apparatus of claim 28 or 31 in which said eddy current shield also includes a cooling means.

36. The apparatus of claim 8 including:

a dam located between said magnetic poles and separated from said rollers;

whereby said dam in cooperation with a magnetic field between said magnetic poles can confine a molten metal between said rollers.

37. The apparatus of claim 36 in which said dam is made of a ferromagnetic material.

38. The apparatus of claim 37 including a layer of high temperature ceramic attached to said dam on the side of said dam on which molten metal can be retained.

39. The apparatus of claim 38 including a liquid-cooled heat shield located between said dam and said layer of high temperature ceramic.

40. The apparatus of claim 6 including:

a supplemental magnet having poles on either side of the gp between said rollers;

whereby said supplemental magnet can cooperate with said magnet to confine a molten metal between said poles of said magnet and said supplemental magnet.

41. The apparatus of claim 6 including:

a sheet cooling means located below said rollers, said sheet cooling means capable of cooling a sheet of cast metal as the sheet passes out from said rollers.

42. The apparatus of claim 6 in which said alternating magnetic field operates between 30 Hz and 16,000 Hz.

43. The apparatus of claim 6 including guide means located below said rollers, said guide means capable of supporting a cast metal sheet leaving said rollers.

* * * * *